US006478391B1

(12) United States Patent
Stoever

(10) Patent No.: US 6,478,391 B1
(45) Date of Patent: Nov. 12, 2002

(54) CABINET

(75) Inventor: John A. Stoever, Cordova, TN (US)

(73) Assignee: Sandusky Cabinets, Inc., Millington, TN (US)

( * ) Notice: Subject to any disclaimer, the term of this patent is extended or adjusted under 35 U.S.C. 154(b) by 0 days.

(21) Appl. No.: 09/454,510

(22) Filed: Dec. 6, 1999

Related U.S. Application Data

(63) Continuation-in-part of application No. 09/098,672, filed on Jun. 17, 1998, now abandoned.

(51) Int. Cl.[7] ..... A47B 48/00
(52) U.S. Cl. ..... 312/265.5; 312/324
(58) Field of Search ..... 312/257.1, 263, 312/265.5, 324, 326, 329, 100, 405; 49/369, 367, 103

(56) References Cited

U.S. PATENT DOCUMENTS

| | | | | |
|---|---|---|---|---|
| 1,084,067 A | | 1/1914 | Budd | |
| 1,499,085 A | | 6/1924 | Trah | |
| 1,944,394 A | * | 1/1934 | Bales et al. | 312/263 |
| 2,438,257 A | * | 3/1948 | Stevenson et al. | |
| 2,571,622 A | | 10/1951 | Schmidt | |
| 4,077,686 A | | 3/1978 | Bukaitz | |
| 4,090,755 A | * | 5/1978 | Johnson | 312/140 X |
| 4,288,132 A | * | 9/1981 | Znamirowski et al. | 312/265.5 |
| 4,289,363 A | | 9/1981 | Andersson et al. | |
| 4,688,492 A | | 8/1987 | Peghetti | |
| 5,221,131 A | | 6/1993 | Lesperance et al. | |

FOREIGN PATENT DOCUMENTS

| | | | | |
|---|---|---|---|---|
| FR | 1514174 | * | 2/1968 | 312/265.5 |
| GB | 645808 | | 11/1950 | |

OTHER PUBLICATIONS

Sandusky Cabinets, Inc., *Storage Solutions*, Sandusky Cabinets, Inc. Sales Brochure; Published Jan. 1998.

* cited by examiner

*Primary Examiner*—Janet M. Wilkens
(74) *Attorney, Agent, or Firm*—Wood, Herron & Evans LLP

(57) ABSTRACT

An improved storage cabinet that is relatively light weight while providing enhanced structural strength. The cabinet has specially formed side panels and back panels which, when joined together, form columns throughout the height of the cabinet's rear corners to enhance the cabinet's structural strength. The cabinet also has an end panel door stop, whose front edge is folded to create a reinforcement section, for cabinet doors to bear against. The cabinet also has double doors with complimentary forty-five degree and one hundred and thirty-five degree angle bends at the double doors' center line to prevent unauthorized line-of-sight access to the contents contained within the cabinet.

10 Claims, 7 Drawing Sheets

CABINET

CROSS REFERENCE

This present application is a continuation-in-part of U.S. Ser. No. 09/098,672, filed on Jun. 17, 1998 and now abandoned the disclosure of which is hereby incorporated herein in its entirety.

FIELD OF THE INVENTION

This invention relates to cabinets. More specifically, this invention relates to a storage cabinet with improved structural strength.

BACKGROUND

Traditional free standing unassembled storage cabinets made from metal, plastic, or other materials generally suffer from a few common problems. They are difficult to assemble, too heavy, and/or lack structural strength. As is often the case, cabinets that are too heavy result from attempts to provide structural strength by either forming the cabinet components from material that is relatively thick, or including in the cabinet's construction a relatively large amount of structural reinforcement to attempt to compensate for cabinet material that is too thin and weak to form a structurally rigid cabinet without such reinforcement. Assembly of free standing cabinets such as these may be time consuming and difficult due to the large number of parts to assemble and/or the increased weight of these parts. Unnecessary weight unduly increases shipping costs.

Storage cabinets are used to hold many different items that will fit, one additional limitation being the capacity of the cabinet to bear a given weight upon its shelves, walls, and other structural components. A free standing cabinet's structural strength must be able to accommodate progressively heavier loads as a user stores more and/or heavier items therein. Thus, as the cabinet's intended load carrying capacity is increased, the cabinet's structural reinforcement normally will be increased by the methods mentioned above to strengthen the cabinet, resulting in cabinets that may be heavy, difficult to assemble and/or expensive due to the increased costs of producing and shipping a cabinet strong enough to bear heavier loads.

Another problem associated with traditional free standing cabinet construction is that cabinets such as these may have abutting double doors with an open gap where the doors meet. This is unsightly and produces an insecure overall appearance.

SUMMARY OF THE INVENTION

It is an objective of the present invention to provide an improved storage cabinet that is relatively light weight for intended load capacity while having improved structural strength and rigidity.

It is a further objective of the present invention to provide an improved storage cabinet that is easy to assemble.

These and other objectives of the present invention are achieved by providing, in one presently preferred form, a storage cabinet that has specially formed back panels and side panels which, when joined together to create each of the cabinet's rear corners, form a column at each corner that can bear greater loads than a traditional cabinet's rear corner. A traditional cabinet corner is often simply formed by joining two overlapping sheets of material. The structure of the cabinets' rear corner according to the invention is much less prone to buckling under high loads than is a traditional cabinet's rear corner, thereby enhancing the cabinet's structural strength. The stability of the cabinet of this invention is further enhanced by the construction of a door stop formed from the front edges of the cabinet's top and bottom panels. The leading edge of each top and bottom panel is folded so as to create a double thickness of material along the leading edge to form a door stop which is stronger than the same door stop formed without the fold.

In another presently preferred form, a support bracket replaces the door stop formed integrally with the cabinet top and bottom panels.

The objectives of the present invention are further achieved by providing double cabinet doors, the first and second door, in preferred form, each having a center edge with complimentary bends approximately equal to forty-five degrees and one hundred and thirty-five degrees, respectively. These complimentary center edges overlap so there is no direct line-of -sight problem associated with the above mentioned traditional abutting edges on prior art cabinet double doors. When closed and secured the double doors of the present invention do not allow direct line-of-sight access to the cabinet's contents.

In another presently preferred form. The stability of the cabinet is enhanced by a support flange attached to the side panels and the cabinet's end panels to help prevent lateral and other forces from bending the side panels and top and bottom panels.

Other advantages of the invention will become more apparent to those of ordinary skill upon review of the following detailed description of the preferred embodiment taken in conjunction with the accompanying drawings.

DETAILED DESCRIPTION OF THE DRAWINGS

Figure 1:
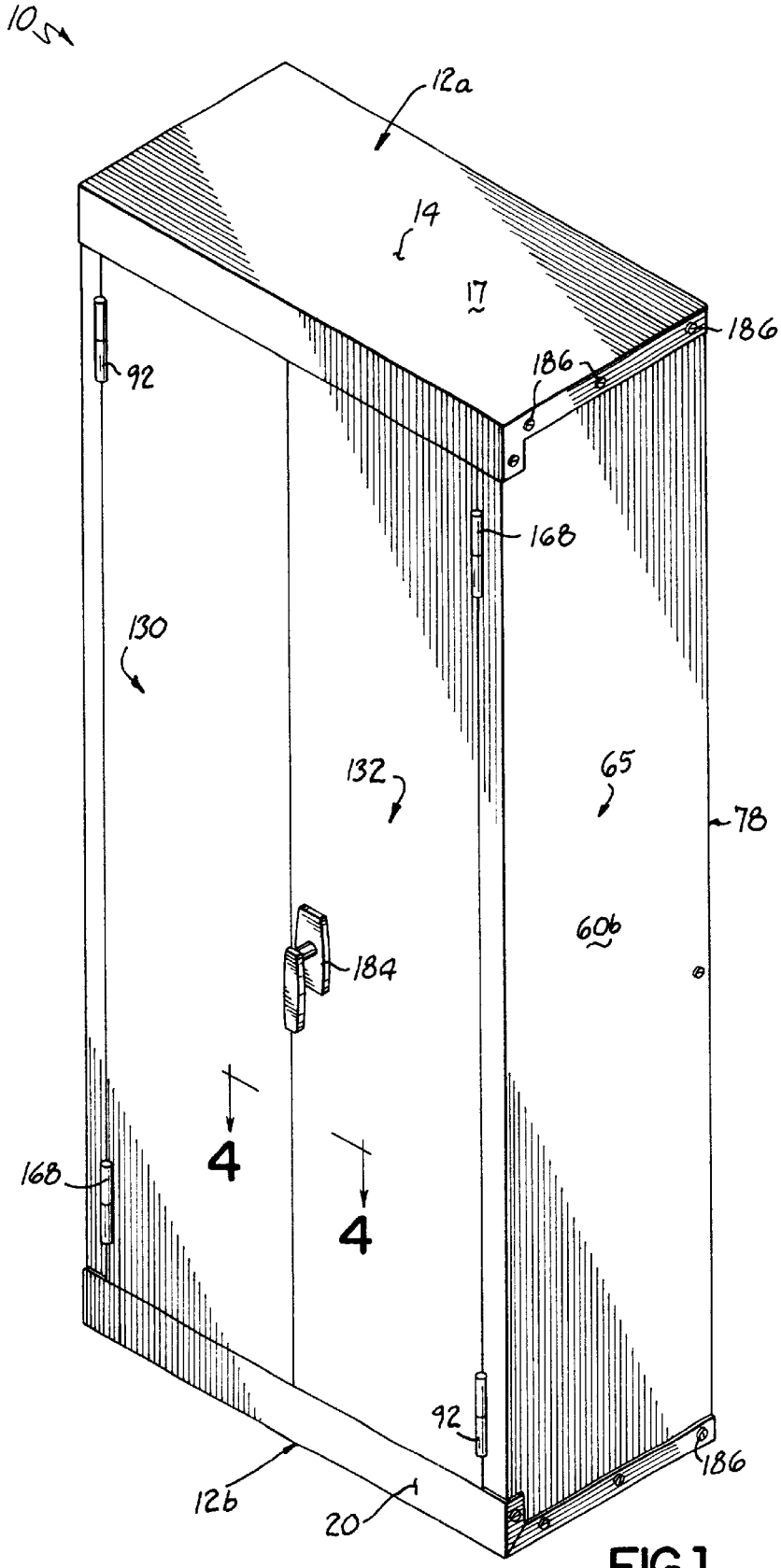
FIG. 1 is a perspective view of an assembled storage cabinet of the present invention.
Figure 2:
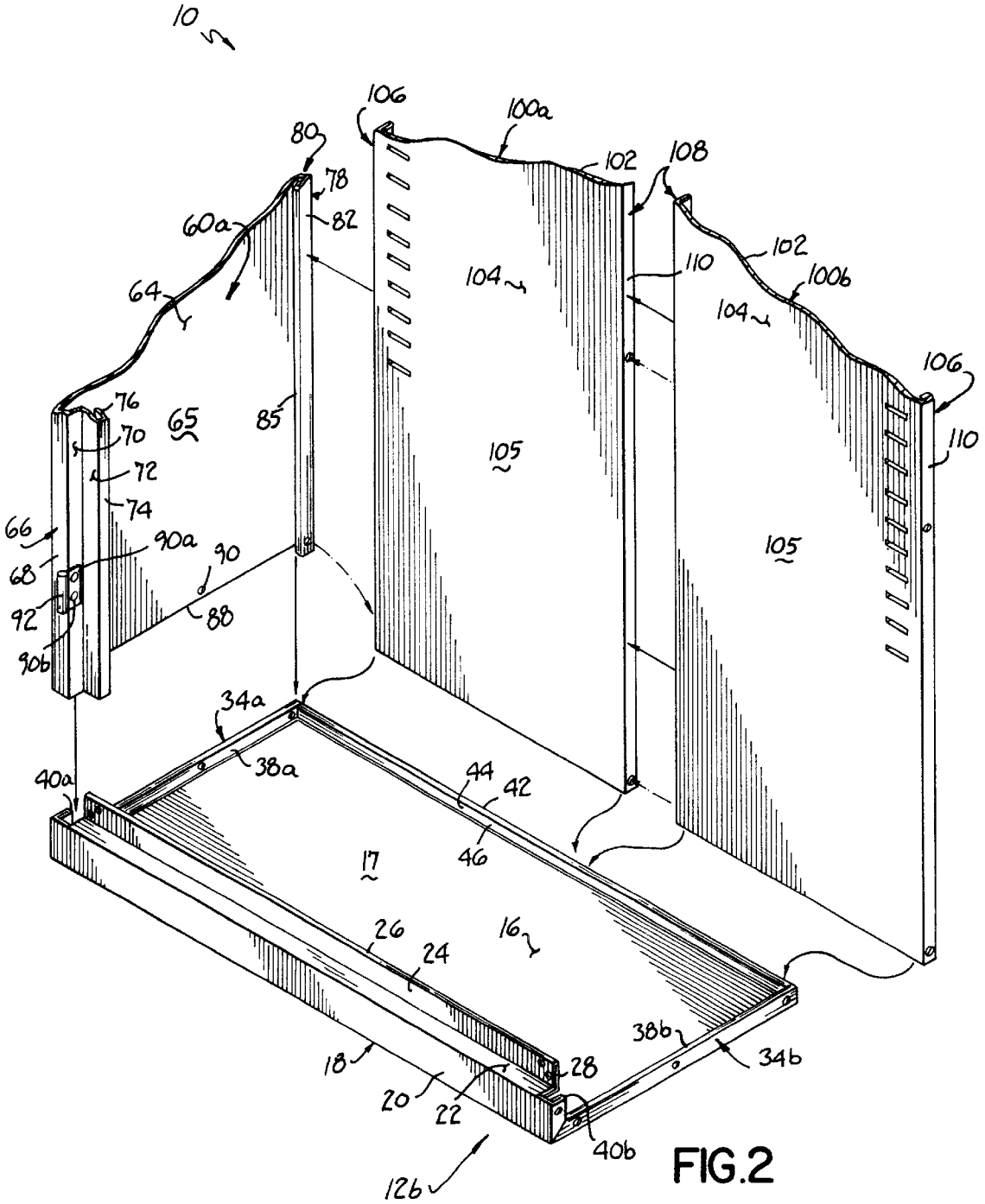
FIG. 2 is a disassembled perspective view of the bottom of the cabinet of FIG. 1.

Referring first to FIGS. 1 and 2, in accord with the principles of this invention and in preferred form, the cabinet 10 is generally comprised of a top panel 12*a*, a bottom panel 12*b*, a left side panel 60*a*, a right side panel 60*b*, a back left panel 100*a*, a back right panel 100*b*, a left door 130 and a right door 132.

Figures 6, 7:
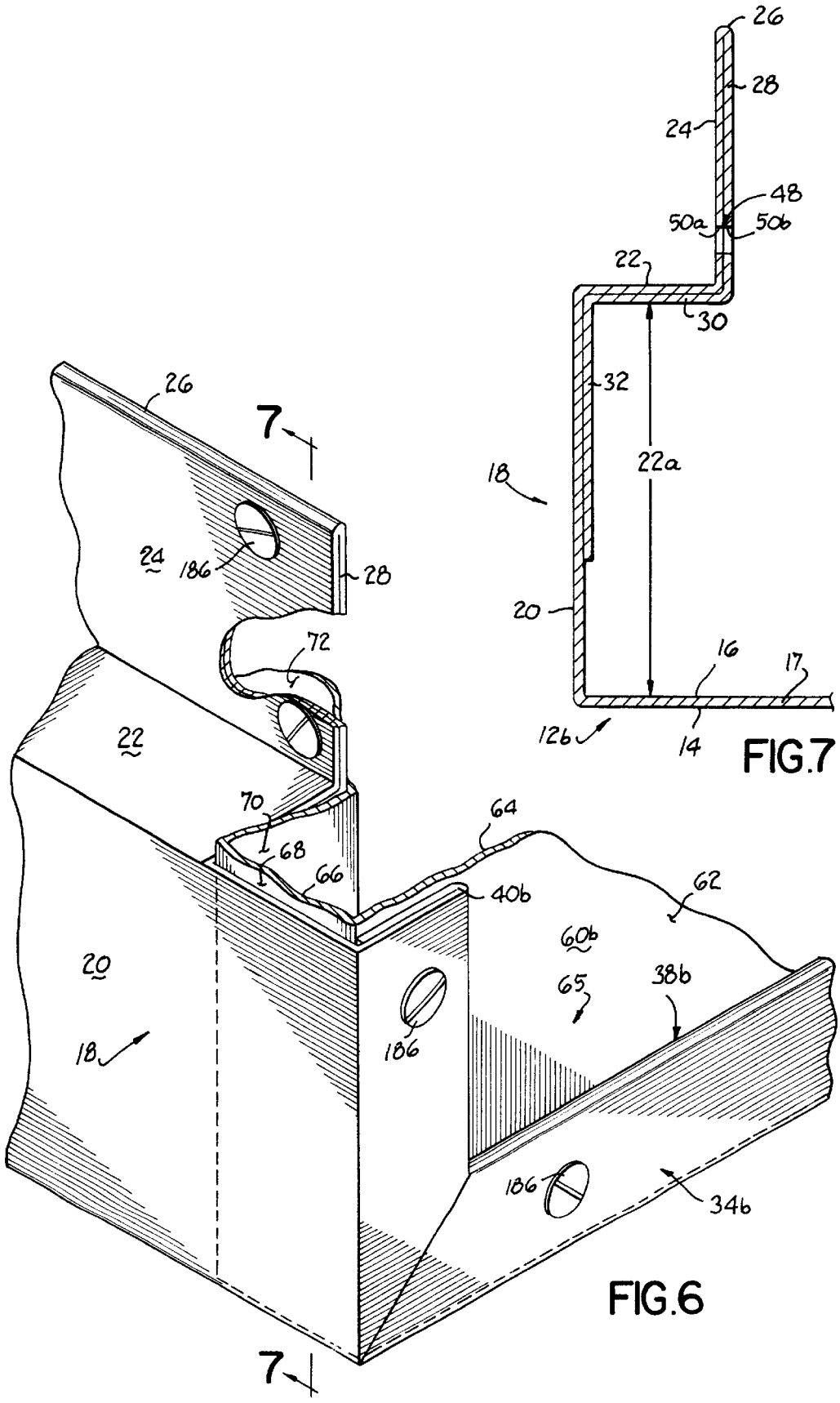
FIG. 6 is a partially cut away perspective view of an end panel assembled to side panel of the cabinet of FIG. 1.
FIG. 7 is a cross sectional view of a door stop taken along lines 7—7 of FIG. 6.

In a first preferred embodiment the top and bottom panels 12*a*, 12*b* have an obverse side 14, a reverse side 16, an end wall 17, a door stop 18, a rear lip 42, a left lip 34*a*, and a right lip 34*b*, as seen in FIGS. 2, 6, 7. For the purposes of better describing the present invention, the top and bottom panels 12*a*, 12*b* are more particularly described as stated above in order to make definite the interrelatedness of the elements defining the top and bottom panels 12*a*, 12*b*. For example, the top and bottom panels 12*a*, 12*b* are described as having the end wall 17 so as to more clearly describe the relationship with the facing 20, described below. The bottom panel 12*b*, includes the facing 20, a return flange 22 and a stop flange 24. When the stop 18 is viewed in cross section as shown in FIG. 7, the reverse side 16 of the facing 20 forms an angle substantially equal to ninety degrees with the reverse side 16 of the end wall 17. Similarly, the reverse side 16 of the return flange 22 forms an angle substantially equal to ninety degrees with the reverse side 16 of the facing 20, overlies the end wall 17, and is spaced therefrom by a gap 22*a*. The obverse side 14 of the stop 24 forms an angle substantially equal to ninety degrees with the obverse side 14 of the return flange 22 and extends away from the end wall 17. The door stop 18 also has an integrally connected door stop reinforcing fold 26 which defines an integrally connected stop plate reinforcement section 28, a return flange reinforcement section 30 and a facing reinforcement section 32, see FIG. 7.

Each of the top panel 12*a* and the bottom panel 12*b* have a left lip 34*a* and a right lip 34*b*. The reverse side 16 of each left and right lip 34*a*, 34*b* forms an angle of approximately ninety degrees with the reverse side of the end wall 17. Each left and right lip 34*a*, 34*b* has integrally connected left and right lip reinforcing folds 38*a*, 38*b* which provides left and right lip reinforcement sections 40*a*, 40*b*, as seen in FIG. 5A. Each of the top panel 12*a* and bottom panel 12*b* also has a rear lip 42, the reverse side 16 of the rear lip 42 forming an angle of approximately ninety degrees with the reverse side of the end wall 17. Like the left and right lips 34*a*, 34*b*, the rear lip 42 has an integrally connected rear lip reinforcing fold 44 which provides a rear lip reinforcement section 46, as seen in FIG. 2. The door stop 18, the left lip 34*a* and the right lip 34*b* all define pairs 48 of overlying apertures 50*a* and underlying apertures 50*b*. The overlying and underlying apertures 50*a*, 50*b* of each aperture pair 48 align approximately coaxially upon forming the stop reinforcing fold 26 and the lip reinforcing folds 38.

Figure 5:
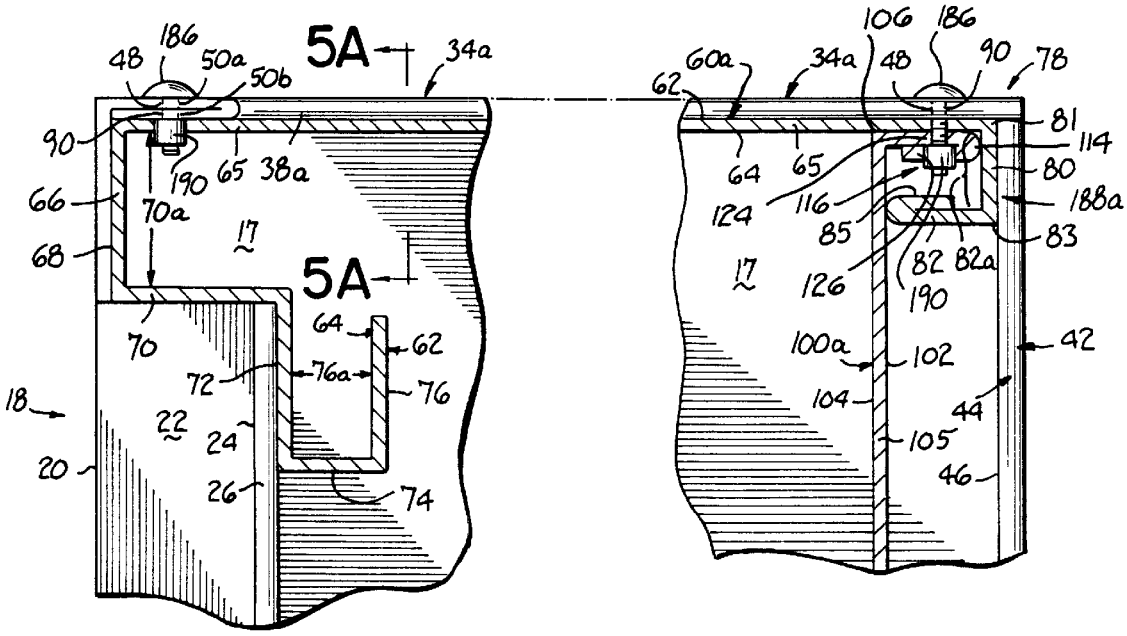
FIG. 5 is a partial cross sectional view taken along line 5—5 of FIG. 3.
Figure 5A:
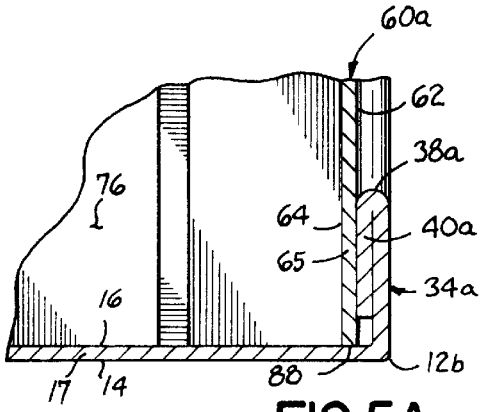
FIG. 5A is a cross sectional view taken along lines 5A—5A of FIG. 5.

Both the left side panel 60*a* and right side panel 60*b* have an obverse side 62, a reverse side 64, a side wall 65, a leading edge 66, and a trailing edge 78, as seen in FIGS. 2 and 5. For the purpose of better describing the present invention, the left and right side panels 60*a*, 60*b* are more particularly described as set forth above in order to make definite the interrelatedness of the elements defining the left and right side panels 60*a*, 60*b*. When viewed in cross section, the leading edge 66 of each left and right side panel 60*a*, 60*b* defines a face wall 68, a door seat 70, 72, and edge finish arm 74, 76. The reverse side 64 of the face wall 68 forms an angle approximately equal to ninety degrees with the reverse side 64 of the side wall 65. The reverse side 64 of the door seat plate 70 forms an angle approximately equal to ninety degrees with the reverse side 64 of the face wall 68, and the obverse side 66 of the door seat plate 72 forms an angle substantially equal to ninety degrees with the obverse side 66 of the door seat plate 70, to form the door seat. The door seat plate 70 is spaced from the side wall 65 by a gap 70*a*. The reverse side 64 of edge finish plate 74 forms an angle approximately equal to ninety degrees with the reverse side 64 of the door seat plate 72, and the reverse side 64 of the edge finish plate 76 forms an angle approximately equal to ninety degrees with the reverse side 64 of the edge finish plate 74, to form the edge finish arm. The edge finish plate 76 is spaced from door seat plate 72 by gap 76*a*. A pair of bottom hinge knuckles 92 is affixed to the surface 70 by flange 90*a* of each left and right side panel 60*a*, 60*b* and secured into place with rivets 90*b*, as seen in FIG. 3.

When viewed in cross section, the trailing edge 78 of each side panel 60*a*, 60*b* has a first rear flange 80 and a second rear flange 82 that cooperate to partially form a structural column in the final cabinet assembly. The reverse side 64 of the first rear flange 80 forms an angle approximately equal to ninety degrees with the reverse side 64 of the side wall 65 having a first bend edge 81. The reverse side 64 of the second rear flange 82 forms an angle approximately equal to ninety degrees with the reverse side 64 of the first rear flange 80 having a second bend edge 83. The second rear flange 82 overlies the side wall 65 but is spaced therefrom by gap 82*a*. The trailing edge 78 is doubled over upon the second rear flange 82 to form an integrally connected second rear flange reinforcement section 85.

Figures 3, 3A:
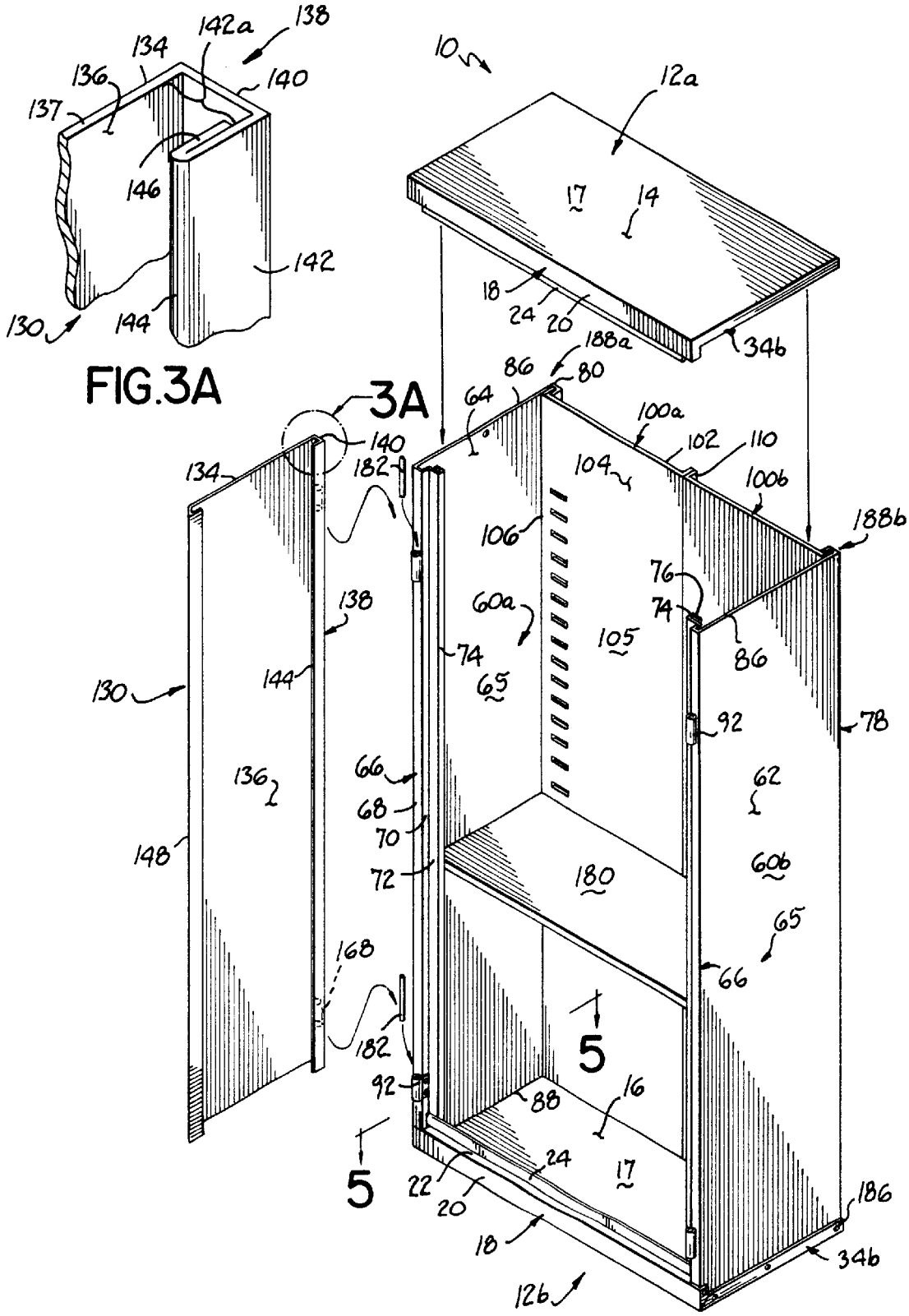
FIG. 3 is a partially disassembled perspective view of a first preferred embodiment of the cabinet of FIG. 1.
FIG. 3A is an enlarged breakaway view of the edge of the left door shown in FIG. 3.

Each of the left and right side panels 60*a*, 60*b* has a top edge 86 and a bottom edge 88, as seen in FIGS. 2 and 3. Each of the top and bottom edges 86, 88 define side wall apertures 90. The obverse side 62 of the side wall 65 adjacent to each of the top and bottom edges 86, 88 of each of the left and right side panels 60*a* , 60*b* are placed inboard of the left and right lips 34*a*, 34*b* of the top and bottom panels 12*a*, 12*b*, and in abutting engagement therewith, and the side wall apertures 90 are aligned substantially coaxially with the aperture pairs 48, when the cabinet 10 is assembled. The leading edge 66 of each side panel 60*a*, 60*b* also defines apertures 90 which align approximately coaxially with the aperture pairs 48 defined in the door stop 18. Screws 186 are received therethrough to affix the left and right side panels 60*a*, 60*b* to the top and bottom panels 12*a*, 12*b* when the cabinet is assembled.

The cabinet 10 has a left back panel 100*a* and a right back panel 100*b*, as seen in FIGS. 2 and 3. Each left and right back panel 100*a*, 100*b* has an obverse side 102, a reverse side 104, a back wall 105, an outside edge 106 and a center edge 108. For the purpose of better describing the present invention, the left and right back panels 100*a* , 100*b* are more particularly described as set forth above in order to make definite the interrelatedness of the elements defining the left and right back panels 100*a*, 100*b*. Both outside and center edges 106, 108 on each left and right back panel 100*a*, 100*b* have an edge flange 110. When viewed in cross section at FIG. 5, the obverse side 102 of the edge flange 110 forms an angle approximately equal to ninety degrees with the obverse side 102 of the back wall 105. Each edge flange 110 formed at the outside edge 106 and the center edge 108 has a reinforcing fold 114 and a flange reinforcement section 116 formed by folding over upon themselves each of the outside edge 106 and the center edge 108. The edge flange 110 formed on both of the outside edge 106 and center edge 108 of each of the left and right back panels 100*a*, 100*b* defines pairs of apertures with an overlying aperture 124 and an underlying aperture 126. Apertures 124, 126 on the edge flange 110 of left 100*a* back panel center edge 108 align substantially coaxially with the apertures 124, 126 on the edge flange 110 of right 100*b* back panel center edge 108, and receive screws 186 therethrough to secure the left and right back panels 100*a*, 100*b* together when the cabinet is assembled.

When the left and right back panels 100*a*, 100*b* are assembled with screws 186 to the left and right side panels 60*a*, 60*b*, respectively, substantially square and hollow structural columns 188*a*, 188*b* are formed, as seen in FIGS. 3 and 5. In order to facilitate ease of assembly of the cabinet, threaded inserts 190 are fitted into the apertures 124,126 to receive the screws 186. It will be appreciated that the threaded inserts 190 are fitted into all apertures that receive screws 186 through out the cabinet's construction to facilitate ease of assembly. This is particularly important in blind applications such as the formation of the structural columns 188*a*, 188*b*. Otherwise, it would be difficult to provide nuts, by way of example, within in gap 82*a* upon forming the columns 188*a*, 188*b* in order to secure the left back panel 100*a* to the left side panel 60*a*.

The components are sized and seated so the reverse side 104 of edge flange 110 on each left 100*a* and right 100*b* back panel outside edge 106 is received against the reverse side 64 of the left 60*a* and right 60*b* side panel walls, respectively, and so each left 60*a* and right 60*b* side panel second surface fold 84 is abutted against the obverse side 102 of each left 100*a* and right 100*b* back panel wall 105, respectively, thereby lending reinforcement to the vertical structural columns 188*a*, 188*b* so formed. The obverse side 102 of each first end flange 106 on the left and right back panels 100*a*, 100*b* is disposed adjacent to the reverse side 64 of each side panel 60*a*, 60*b* and positioned between the side panel's 60*a*, 60*b* respective second rear flanges 82. Note these structural columns 188*a*, 188*b* are located outside the cabinet's interior so that a rectangular shelf 180 may be located flush against the cabinet back panels 100*a*, 100*b* without the structural columns 188*a*, 188*b* interfering with the flush positioning of the shelf 180.

The cabinet has a left door 130 and a right door 132, both of which have an obverse side 134, a reverse side 136, a cabinet wall 137, and a hinge edge 138, as seen in FIGS. 1,3 and 3A. For the purpose of better describing the present invention, the left and right doors 130, 132 are more particularly described as set forth above in order to make definite the interrelatedness of the elements defining the left and right doors 130, 132. At the hinge edge 138, each of the left and right doors 130, 132 has a first door flange 140, the reverse side 136 of the first door flange 140 forming an angle of approximately ninety degrees with the reverse side 136 of the cabinet wall 137. Also at the hinge edge 138, each of the left and right doors 110, 112 also has a second door flange 142, the reverse side 136 of the second door flange 142 forming an angle of approximately ninety degrees with the reverse side 136 of the first door flange 140, overlying the cabinet wall 137, and being spaced therefrom by a gap 142*a*. Each second door flange 142 has a reinforcing fold 144 with an integrally connected second door flange reinforcement section 146.

Figure 4:
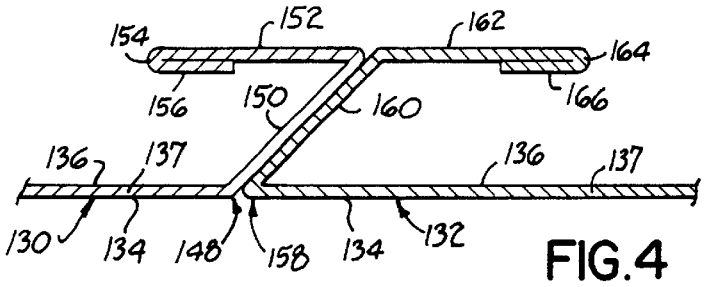
FIG. 4 is a cross sectional view taken along line 4—4 of FIG. 1.

As is seen in cross section in FIG. 4, the left door 130 has a left center edge 148 with a left obtuse wall 150. The reverse side 136 of the left obtuse wall 150 forms an angle of approximately one hundred and thirty-five degrees with the reverse side 136 of the left door wall 137. The left door 130 also has a left acute wall 152. The left acute wall 152 forms an angle of approximately forty-five degrees with the reverse side 136 of the obtuse wall 150. The left door 130 further has a left acute fold 154 which is integrally connected to an acute wall reinforcement section 156.

The right door 132 has a right center edge 158 with a right acute wall 160. The reverse side 136 of the right acute wall 160 that forms an angle of approximately forty-five degrees with the reverse side 136 of the right door wall 137. The right door 132 also has a right obtuse wall 162. The right obtuse wall 162 forms an angle of approximately one hundred and thirty-five degrees with the reverse side 136 of the right acute wall 160. The right door 112 further has a right obtuse fold 164 which is integrally connected to an obtuse wall reinforcement section 166. Each of the left and right doors 130, 132 has a pair of top hinge knuckles 168 placed in operational relationship with the bottom hinge knuckles 92 on each of the left and right side panels 60*a*, 60*b* when the cabinet is assembled. It will be understood that the top hinge knuckles 168 are riveted to the first door flange 140 in the same manner as the bottom hinge knuckles 92 are affixed to surface 70 with flange 90*a* and rivets 90*b*. The top hinge knuckles 168 are secured to the bottom hinge knuckles 92 with hinge pins 182.

The cabinet 10 has a shelf 180 fixed in position at approximately mid-height within the cabinet 10. Additional shelves (not shown) may be installed as desired. A locking door handle 184 is fixed to the right door 132 at approximately the same height at which the shelf 180 is placed within the cabinet 10.

Figure 7A:
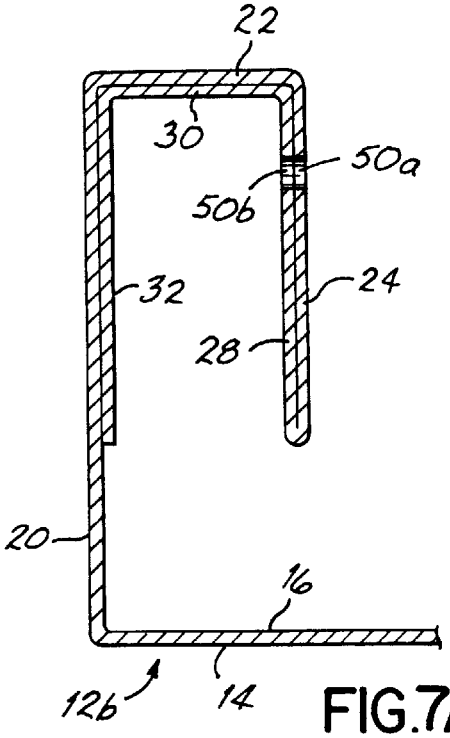
FIG. 7A is a similar view to FIG. 7 but showing the construction of a second preferred embodiment.
Figure 8:
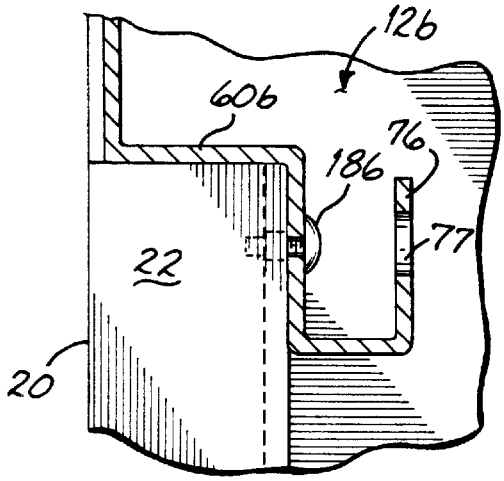
FIG. 8 is a similar view to FIG. 5 but showing the construction of the second preferred embodiment of FIG. 7A.

In a second preferred embodiment shown in FIGS. 7A and 8, the stop flange 24 is formed at an angle substantially equal to ninety degrees with the obverse side 14 of the return flange reinforcing section 30. In this embodiment, the edge finish plate 76 has a finish plate aperture 77 so when the left and right side panels 60*a*, 60*b* are fitted for assembly to the top and bottom ends 12*a*, 12*b* a user may easily access the apertures 50*a*, 50*b* in the stop plate 24 and stop plate reinforcement section 28, respectively, in order to secure the side panels 60*a*, 60*b* to the top and bottom ends 12*a*, 12*b* with the screws 186.

Figure 9:
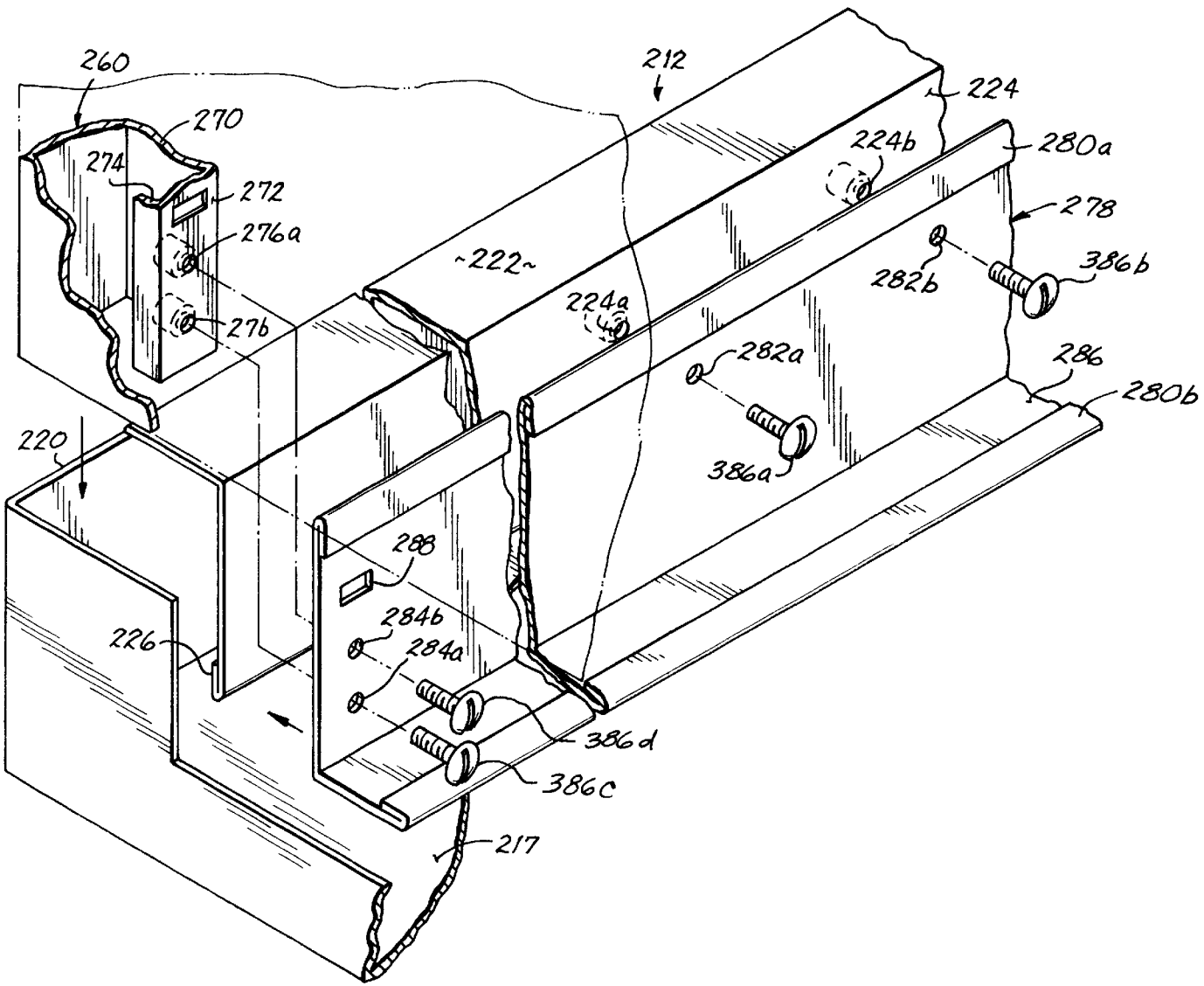
FIG. 9 is a partial perspective view of the bottom of a third preferred embodiment of the cabinet of FIG. 1.

In a third preferred embodiment, as seen in FIG. 9, a pair of top and bottom end panels 212 (only one shown, the other being a mirror image thereof) has a return flange 222 and a support flange 224 defining flange apertures 224*a*, 224*b*. The support flange 224 has a safety hem 226 to prevent a user from injury during assembly. A support bracket 278 is received against the support flange 224 in order to enhance the structural rigidity of the support flange 224. The support bracket 278 defines a pair of support apertures 282*a*, 282*b* which overlay and are coaxial with flange apertures 224*a*, 224*b*, respectively. Screws 386*a*, 386*b* are received through the support apertures 282*a*, 282*b* and the flange apertures 224*a*, 224*b* to secure the support bracket 278 to the support flange so that a floor flange 286 is received against the end wall 217 of the end panel 212.

As further seen in FIG. 9, a side panel 260 has a door seat 270 a seat return flange 272 and a finish plate 274. The seat return flange 272 defines apertures 276*a*, 276*b* which underlie apertures 284*a*, 286*b*, respectively, defined in the support bracket 278. Screws 386*c*, 386*d* are received through apertures 284*a*, 284*b* and apertures 276*a*, 276*b*, respectively, to secure the support bracket 278 to the side panel 260 in order to enhance the structural rigidity of the cabinet 10. Thus, the support bracket 278 ties together the side panel 260 and the end panels 212 by virtue with being secured to both, thereby further enhancing the strength of the cabinet 10.

The support bracket 278 has safety hems 280*a*, 280*b* to help prevent injury to a user during installation. The support bracket 278 also has shelf holes 288 (one of which being shown) which receive a shelf tab (not shown) therein to support a shelf within the cabinet 10.

It will be appreciated that use of the structure described in the third preferred embodiment (FIG. 9) eliminates or replaces at least elements 24, 28, 30, 32, 72, 74 and 76 in the other embodiments described above and provides an alternative support structure for strengthening and stabilizing the cabinet 10. More particularly, the support bracket 278 rises above the return flange 222 to replace the stop flange 24 and, thereby, function as a stop for the cabinet doors 130, 132. Alternatively, the support bracket 278 may be even with the return flange 222 for use in the embodiment shown in FIG. 7A, wherein the doors 130, 132 may be eliminated from the cabinet 10.

Additional advantages and modifications will readily appear to those skilled in the art. The invention in its broader aspects is therefore not limited to the specific detail, representative apparatus and illustrative example shown and described. This has been a description of the present invention as currently known. However, the invention itself should only be defined by the appended claims, wherein we claim.

I claim:

1. A cabinet, comprising:

a top and a bottom end panel each having an end wall, an end reverse side, a door stop and a facing located at an angle of about 90° relative to said end wall and extending away from said end reverse side, at least one of said top and bottom end panel having a facing reinforcement section overlaying said facing and being integrally connected therewith by a door stop reinforcing fold, at least one side panel having a reverse side and a trailing edge, said trailing edge forming a first rear flange integral with said side panel and a second rear flange integral with said side panel, said first and second rear flange cooperating to partially form a structural column, said first rear flange extending outwardly from said side panel reverse side, and said reverse side of said second rear flange overlying said side panel reverse side but being spaced therefrom by a gap, at least one back panel having an obverse side and an outside edge, said outside edge forming an edge flange adapted to cooperate with said first and second rear flanges to form said structural column, said edge flange extending outwardly from said back panel obverse side, and a first door and a second door, each of said first and second doors having a door reverse side and a door center edge, said first door having a door center edge bend of about 135° towards said first door reverse side, and said second door having a door center edge bend of about 45° towards said second door reverse side.

2. A cabinet, comprising:

a top and a bottom end panel each having an end wall, an end obverse side, an end reverse side, an integral door stop and an integral facing located in a first plane at an angle of about 90° relative to said end wall and extending away from said reverse side of said end wall, at least one of said top and bottom end panels having an integral facing reinforcing section overlaying said facing and being integrally connected therewith by a door stop reinforcing fold, said facing having an integral return flange located at an angle of about 90° relative to said facing and extending away from said obverse side of said facing, said door stop being located in a second plane parallel to, but spaced apart from said first plane, and being located on the same side of said panel as said facing.

3. The cabinet of claim 2, wherein said return flange has a return flange reinforcement section overlaying said return flange and being integrally connected therewith by said door stop reinforcing fold.

4. A pair of doors for a cabinet, comprising:

a first door and a second door, each of said first and second doors having a door reverse side and a door center edge, said first door having a door center edge bend of about 135° towards said first door reverse side, and said second door having a door center edge bend of about 45° towards said second door reverse side, wherein said first door has a second center edge bend of about 45° towards said first door reverse side, said first door center edge having a first door reinforcing plate integrally connected therewith by a first door fold, and wherein said second door has a second center edge bend of about 135° towards said second door reverse side, said second door center edge having a second door reinforcing plate connected therewith by a second door fold.

5. A cabinet, comprising:

a top and a bottom end panel each comprising an end wall;

at least one of said top and bottom panels having formed integral therewith a support flange and a facing located at an angle of about 90° relative to said end wall, at least one side panel having a seat return flange, and a trailing edge, said seat return flange being substantially coplanar with said support flange, said trailing edge forming a first rear flange integral with said side panel and a second rear flange integral with said side panel, said first and second rear flanges cooperating to partially form a structural column, said second rear flange overlying said side panel but being spaced therefrom by a gap, a support bracket attached to said support flange and said seat return flange a portion of said support bracket being received against said side panel to enhance the structural rigidity of the cabinet, at least one back panel having an edge flange cooperating with said first and second rear flanges of said side panel to form said structural column, and a first door and a second door, each of said first and second doors having a door reverse side and a door center edge, said first door having a door center edge bend of about 135° towards said first door reverse side, and said second door having a door center edge bend of about 45° towards said second door reverse side.

6. A cabinet, comprising:

a top and a bottom end panel each comprising an end wall;

at least one of said top and bottom panels having formed integral therewith a support flange and a facing located at an angle of about 90° relative to said end wall and extending away from said end wall, said support flange being spaced inboard of said facing and comprising a planar surface parallel to said facing; and a support bracket attached to the planar surface of said support flange, a portion of said support bracket being received on said at least one panel to enhance the structural rigidity of the cabinet.

7. A cabinet comprising:

at least one of a top panel and a bottom panel;

at least one side panel having a seat return flange; and a support bracket comprising an abutting surface attached to said seat return flange, a portion of said support bracket being received against said side panel to enhance the structural rigidity of the cabinet; and said seat return flange comprising a planar surface extending parallel to said abutting surface of said support bracket and to which said support bracket is attached.

8. A cabinet comprising:

an end panel comprising a wall having a forward edge and a facing extending at an angle from the wall;

a return flange extending rearwardly from said facing;

a support flange extending from said return flange toward said wall; and a support bracket attached to said support flange and engaging said wall.

9. A cabinet as in claim 8, wherein said support bracket comprises a door stop portion extending from a position adjacent the junction of said support flange and said return flange.

10. A cabinet as in claim 8, further comprising:

a side wall comprising a seat return flange;

said seat return flange having a surface parallel to said support flange; and said support bracket being attached to said seat return flange and said support flange.

* * * * *